US008141639B2

(12) United States Patent
Gartz et al.

(10) Patent No.: US 8,141,639 B2
(45) Date of Patent: Mar. 27, 2012

(54) DETONATOR FOR MATERIAL-DISPENSING WELLBORE TOOLS

(75) Inventors: Jeffrey David Gartz, Blackfalds (CA); Garret William Hansen, Lacombe (CA); Robert Michael Frederick Lesiuk, Ponoka County (CA)

(73) Assignee: Owen Oil Tools LP, Houston, TX (US)

( * ) Notice: Subject to any disclaimer, the term of this patent is extended or adjusted under 35 U.S.C. 154(b) by 106 days.

(21) Appl. No.: 12/684,516

(22) Filed: Jan. 8, 2010

(65) Prior Publication Data

US 2010/0175889 A1 Jul. 15, 2010

Related U.S. Application Data

(60) Provisional application No. 61/143,542, filed on Jan. 9, 2009.

(51) Int. Cl.
*E21B 27/02* (2006.01)

(52) U.S. Cl. ..... 166/286; 166/169; 166/63

(58) Field of Classification Search ..... 166/169, 166/63, 286
See application file for complete search history.

(56) References Cited

U.S. PATENT DOCUMENTS 2,526,021 A * 10/1950 Fultz ..... 166/169
2,591,807 A 4/1952 Greene
2,689,008 A 9/1954 Allen et al.
2,696,258 A 12/1954 Greene
2,725,940 A 12/1955 Shidell et al.
2,956,625 A * 10/1960 Toelke ..... 166/63
3,154,149 A * 10/1964 Peters ..... 166/169
3,187,813 A 6/1965 Greene, Jr.
3,208,521 A 9/1965 Holland et al.
3,208,525 A * 9/1965 Caldwell et al. ..... 166/295
3,318,393 A 5/1967 Brown
3,379,251 A 4/1968 Bohn
4,696,343 A 9/1987 Anderson et al.
4,739,829 A 4/1988 Brunner
5,052,489 A * 10/1991 Carisella et al. ..... 166/297
6,041,857 A 3/2000 Carmody et al.
6,543,532 B2 4/2003 Estep et al.
7,287,591 B2 10/2007 Campbell

* cited by examiner

*Primary Examiner* — Nicole Coy
(74) *Attorney, Agent, or Firm* — Mossman, Kumar & Tyler PC

(57) ABSTRACT

An apparatus for use in dispensing fluid into a wellbore includes a piston element releasably coupled to a housing and a detonator in the housing that applies a force sufficient to release the piston element from the housing when activated. The apparatus also has an intermediate section that mates with the upper section, an elongated member coupled to the piston and that is positioned in a bore of the intermediate section; and a lower section having a housing that mates with the intermediate section. The housing includes at least one opening providing communication between a bore of the housing and an exterior of the housing; and a movable barrier in the lower section. The movable barrier has a first position, wherein the barrier substantially blocks communication between the bore of the intermediate section and the at least one opening, and a second position, wherein the barrier does not substantially block communication between the bore of the intermediate section and the at least one opening.

19 Claims, 3 Drawing Sheets

DETONATOR FOR MATERIAL-DISPENSING WELLBORE TOOLS

CROSS REFERENCE TO RELATED APPLICATIONS

This application claims priority from U.S. Provisional Application Ser. No. 61/143,542 filed Jan. 9, 2009.

BACKGROUND OF THE DISCLOSURE

1. Field of Disclosure

The present disclosure relates to an apparatus and method for perforating a well casing and/or a subterranean formation.

2. Description of the Related Art

During the construction, completion, recompletion, or work-over of oil and gas wells, there may be situations wherein one or more materials may need to be conveyed and ejected into a wellbore at a selected depth. One method for performing such an operation involves conveying a dump bailer into the wellbore on tubing or wireline. When activated, the dump bailer releases a material into the wellbore. The zone of interest may be hundreds or even thousands of feet away form the surface. Therefore, the devices utilized for activation should be robust and reliable in order to ensure proper operation of the dump bailer.

In aspects, the present disclosure addresses the need for devices and methods for providing more effective operation of devices configured to dispense one or more materials into a wellbore.

SUMMARY OF THE DISCLOSURE

In aspects, the present disclosure provides an apparatus for activating a wellbore tool. The apparatus may include an upper section having a housing; a piston element releasably coupled to the housing; a detonator in the housing that applies a force sufficient to release the piston element from the housing when activated; an intermediate section having a first end matable with the upper section and having a bore; an elongated member having a first end coupled to the piston and a second end, the elongated member being at least partially positioned in the bore of the intermediate section; a lower section having a housing matable with a second end of the intermediate section, the housing including at least one opening providing communication between a bore of the housing and an exterior of the housing; and a movable barrier in the lower section that has a first position, wherein the movable barrier substantially blocks communication between the bore of the intermediate section and the at least one opening, and a second position, wherein the movable barrier does not substantially block communication between the bore of the intermediate section and the at least one opening. In embodiments, the elongated member may be substantially rigid. The elongated member may include at least two segments. In arrangements, the intermediate section may be formed of at least two modules. Also, the detonator may be configured to detonate in response to an electrical signal. In variants, a frangible member may connect the piston member to the upper section housing. Also, a detonator block may receive the detonator. In such an embodiment, the piston member may sealingly mate with the detonator block.

In aspects, the present disclosure also provides a system for actuating a downhole tool. The system may include a conveyance device; and a tool coupled to the conveyance device. The tool may include an upper section; a piston element releasably coupled to the upper section; a detonator in the upper section that applies applies a force sufficient to release the piston element from the upper section when activated; an intermediate section matable with the upper section and having a bore; an elongated member having a first end coupled to the piston and a second end, the elongated member being at least partially positioned in the bore of the intermediate section; a lower section matable with a second end of the intermediate section and including at least one opening providing communication between a bore of the intermediate section and an exterior of the tool; and a movable barrier positioned in the lower section, the movable barrier having a first position, wherein the movable barrier substantially blocks communication between the bore of the intermediate section and the at least one opening, and a second position, wherein the movable barrier does not substantially block communication between the bore of the intermediate section and the at least one opening. In embodiments, the conveyance device may be a wireline. Also, the system may include a controller configured to transmit a firing signal to the detonator via the wireline.

In aspects, the present disclosure also provides a method for activating a wellbore tool. The method may include: conveying the wellbore tool into a wellbore; and activating a detonator. The wellbore tool may comprise: an upper section; a piston element releasably coupled to the upper section; a detonator in the upper section that applies applies a force sufficient to release the piston element from the upper section when activated; an intermediate section matable with the upper section and having a bore; an elongated member having a first end coupled to the piston and a second end, the elongated member being at least partially positioned in the bore of the intermediate section; a lower section matable with a second end of the intermediate section and including at least one opening providing communication between a bore of the intermediate section and an exterior of the tool; and a movable barrier positioned in the lower section, the movable barrier having a first position, wherein the movable barrier substantially blocks communication between the bore of the intermediate section and the at least one opening, and a second position, wherein the movable barrier does not substantially block communication between the bore of the intermediate section and the at least one opening. In embodiments, the method may also include: transmitting an electrical signal to detonate the detonator. The method may also include sealingly mating the piston member with the detonator block in embodiments wherein the detonator block receives the detonator.

The above-recited examples of features of the disclosure have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
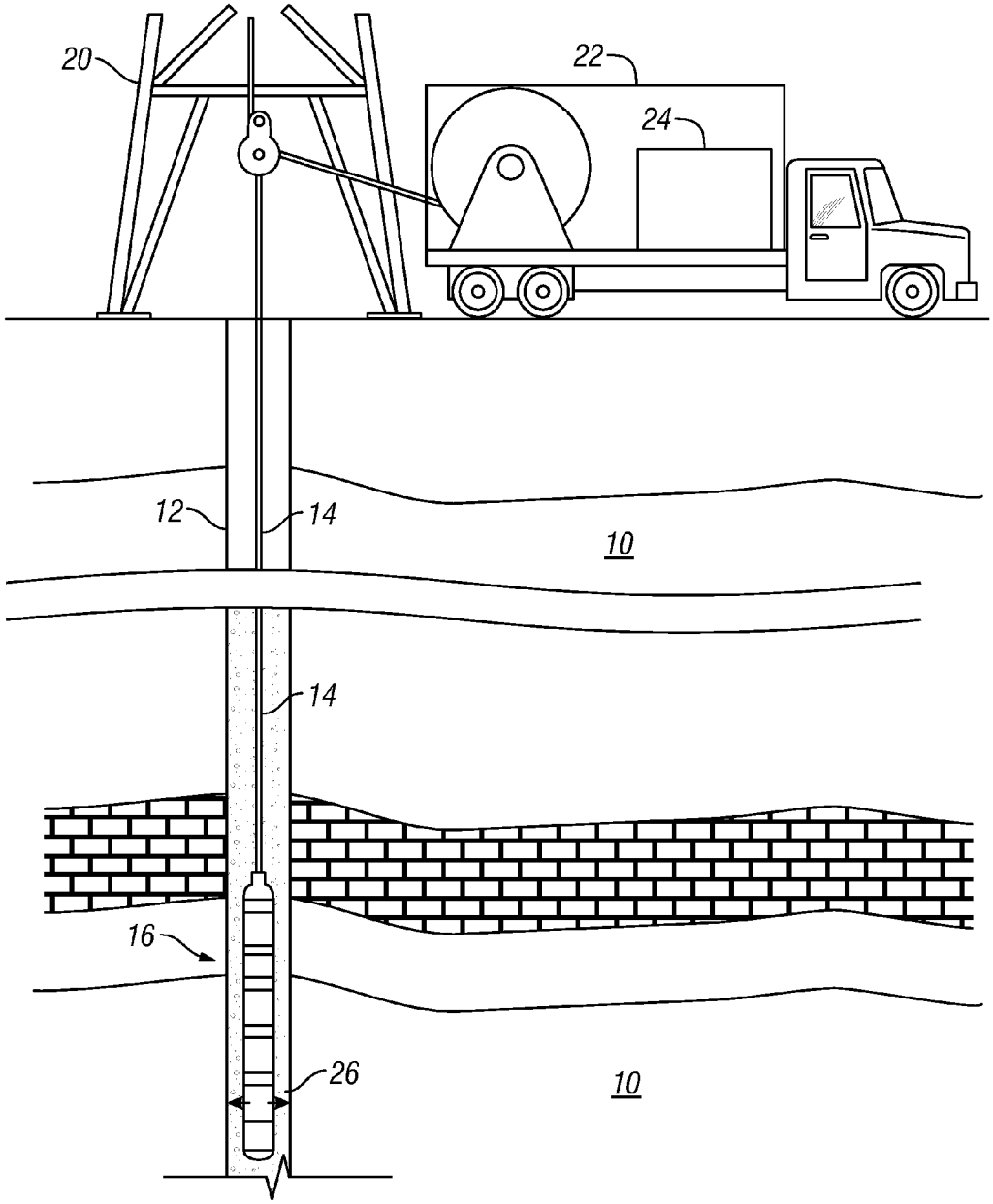
FIG. 1 is a schematic sectional view of one embodiment of a detonator system of the present disclosure.

As will become apparent below, the present disclosure provides an efficient device for activating tools configured to dispense one or more materials into a wellbore. As will be appreciated, the present disclosure is susceptible to embodiments of different forms. There are shown in the drawings, and herein will be described in detail, specific embodiments of the present disclosure with the understanding that the present disclosure is to be considered an exemplification of the principles of the present disclosure, and is not intended to limit the disclosure to that illustrated and described herein.

Referring initially to FIG. 1, there is shown a wireline deployed tool string for dispensing one or more materials into a wellbore. While a land system is shown, the teachings of the present disclosure may also be utilized in offshore or subsea applications. FIG. 1 schematically shows a laminated earth formation 10 intersected by a wellbore 12. A wireline 14 conveys a material dispensing tool 16 into the wellbore 12. The wireline 14 is suspended in the wellbore 12 from a rig 20. The wireline operation may be conducted by surface personnel using a suitable platform 22 that has equipment such as a controller 24 having processors, control devices, memory devices, etc. for operating and communicating with the tool 16. The equipment associated with wireline operations are known in the art and will not be discussed in further detail. After the tool 16 is appropriately positioned, a signal, such as an electrical signal, may be transmitted via the wire 14 to the tool 16. Upon receipt of the signal, the tool 16 dispenses one or more materials 26 into the wellbore 12.

Figure 2:
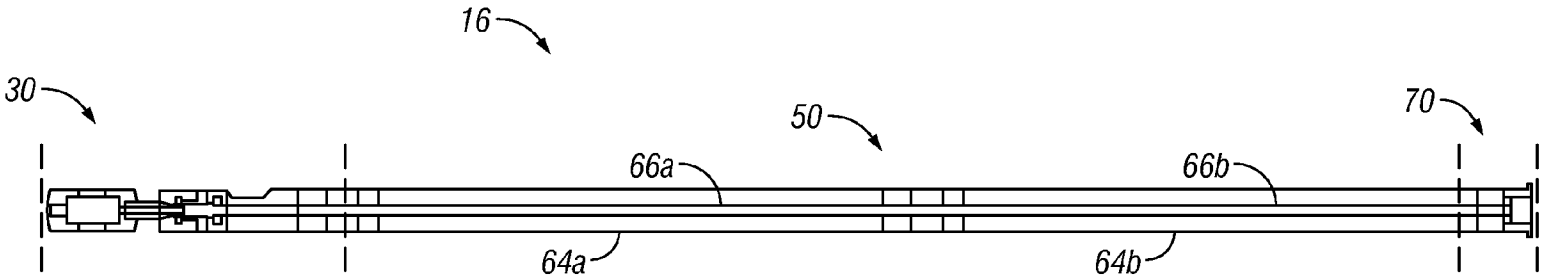
FIG. 2 is a schematic view of an embodiment of a tool in accordance with the present disclosure.

Referring now to FIGS. 2-5, there is shown in greater detail the components of the tool 16. Referring first to FIG. 2, in one embodiment, the tool 16 may include an upper sub 30, a material dispensing section 50, and a lower sub 70. The term "sub" is intended to generically refer to a section or a portion of a tool string. While a sub may be modular and use threaded connections, no particular configuration is intended or implied by the use of the term sub. The upper sub 30 is configured to receive an activation signal and initiate operation of the tool 16. The material dispensing section 50 may be configured to receive and contain one or more materials. The material may be cement, an acid, a slurry, a liquid, a carrier fluid with an entrained solid, a gel or any other material. The lower sub 70 is configured to release the material into the wellbore 12 when actuated by the upper sub 30.

Figure 3:
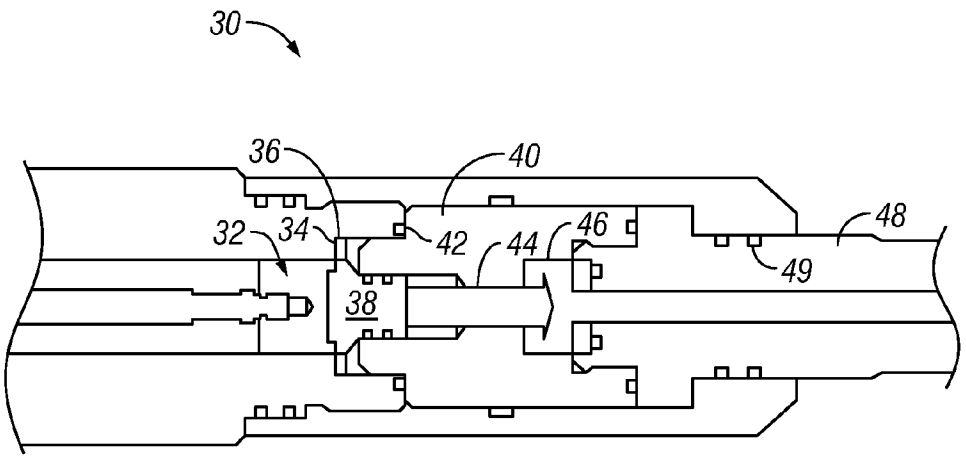
FIG. 3 is a schematic sectional view of an upper section having a detonator made in accordance with one embodiment of the present disclosure.

Referring now to FIG. 3, there is shown greater details for the upper sub 30. In one configuration, the upper sub 30 includes a piston 32 that is held in place within the upper sub 30 by one or more frangible elements 34. The frangible elements 34 may at one end be fixed to the piston 32 and at another end seat against a suitable feature in the upper sub 30, such as a shoulder or ledge 36. The piston 32 may include a head portion 38 that is shaped to mate with a detonator block 40. The mating surfaces of the head portion 38 and the detonator block 40 may be sealed using suitable seals 42, such as o-rings, to keep fluid out of the detonator block 40. In one arrangement, the detonator block 40 includes a detonator 44 that is positioned within a suitable cavity 46. The detonator block 40 may be coupled to a conventional module 48 that is connected to the wire line 14 (FIG. 1). The module 48 may include suitable seals 49 for substantially isolating the detonator 44 from the wellbore environment. Thus, it should be appreciated that the detonator block 40, when assembled with the mating components, substantially isolates the detonator 44 from the wellbore environment. The module 48 is configured to transmit the firing signal, such as the electrical signal, from the wire line 14 to the detonator 44.

Figure 4:
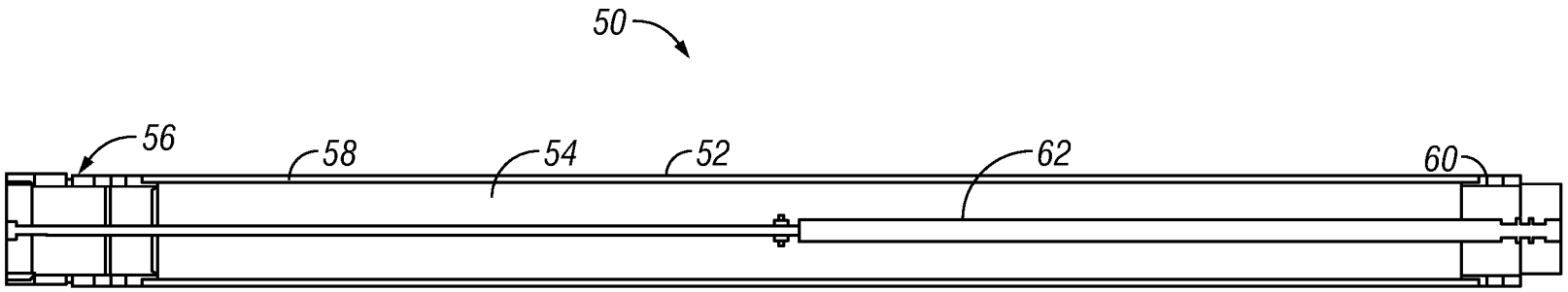
FIG. 4 is a schematic sectional view of a material dispensing section having a detonator made in accordance with one embodiment of the present disclosure.

Referring now to FIG. 4, there is sectionally shown a material dispensing section 50 for receiving and storing a quantity of material. The material dispensing section 50 may be formed of one or more housing elements 52 that may be formed as tubulars. The material dispensing section 50 has an internal bore 54 that is configured to receive and store one or more materials. The material dispensing section 50 may include one or more ports 56 at an upper end 58 through which the material may be conveyed into the internal bore 54. The upper end 58 is configured to couple to the upper sub 30 and a lower end 60 is configured to couple to the lower sub 70. Positioned within the internal bore 54 is an elongated member 62 that runs from the upper sub 30 to the lower sub 70. The function of the elongated member 62 will be discussed in greater detail below.

Figure 5:
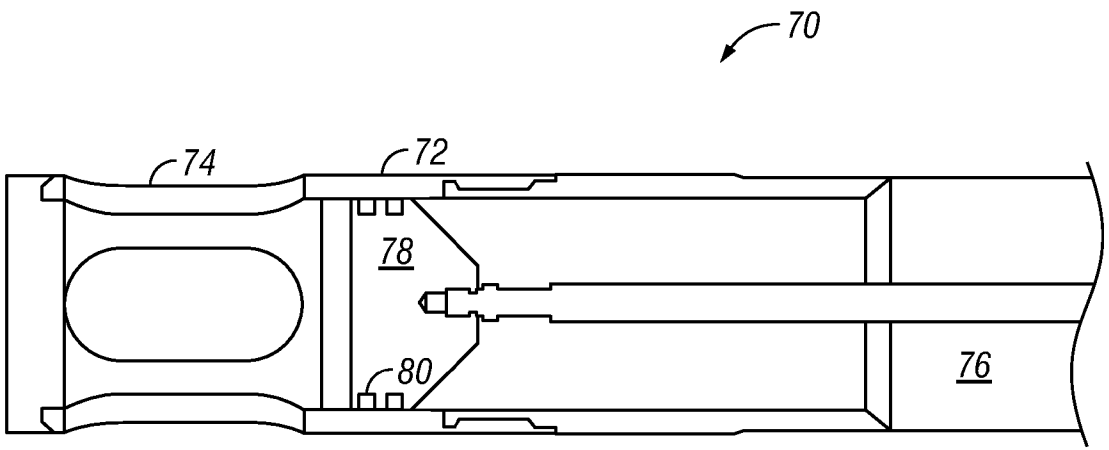
FIG. 5 is a schematic sectional view of a lower section having a movable barrier made in accordance with one embodiment of the present disclosure.

Referring now to FIG. 5, there is sectionally shown the lower sub 70. The lower sub 70 includes a housing 72 in which are formed one or more ports 74 that provide fluid communication between a bore 76 of the housing and the exterior of the lower sub 70. Positioned within the bore 76 of the lower sub 70 is a movable barrier 78. The movable barrier 78 is configured to obstruct or block flow in the bore 76. In arrangements, the movable barrier 78 may include one or more seal elements 80. Referring now to FIGS. 4 and 5, in one embodiment, the barrier 78 is connected to the elongated member 62. Thus, in embodiments where the elongated member 62 is rigid, such as a rigid rod, the piston 32, the elongated member 62, and the barrier 78 move in unison as an integral unit or assembly. The barrier 78 may be formed as a disk, a plunger or other suitable body that substantially occludes the bore 76. The barrier 78 moves between a first position uphole of the ports 74, as shown in FIG. 5, and a second position downhole of the ports 74. In the first position, the barrier 78 prevents material in internal bore 54 of the material dispensing section 50 from flowing or exiting through the ports 74. Thus, when the barrier 78 is in the first position, a reservoir for holding one or more materials is formed by walls of the intermediate and lower sections 50, 70 and the barrier 78. In the second position, because the barrier 78 is positioned downhole of the ports 74, the ports 74 can communicate with the internal bore 54 and allow material in the internal bore 54 to exit the tool 16 via the bore of the lower sub 76.

Referring now to FIGS. 1-5, in one mode of operation, personnel at the rig 20 charge the material dispensing section 50 with one or more materials, such as cement. The barrier 78 is initially in the first position. Thus, the material is retained within the internal bore 54. Due to gravity, the weight of the material applies a downward force to the barrier 78. However, the barrier 78 is held stationary by the elongated member 62, the piston 32, and the frangible elements 34. Thereafter, the tool 16 is conveyed into the wellbore 12 using the wireline 14. After the tool 16 is positioned at the appropriate depth, personnel may use a controller 24 to transmit an electrical signal via the wireline 14 to the detonator 44. In response to the electrical signal, the detonator 44 detonates and applies a percussive force or shock wave that partially or completely snaps, fractures or disintegrates the frangible elements 34. Thereafter, due to the weight of the material in the internal bore 54, the barrier 78, the elongated member 62, and the piston 32 slide downward such that the barrier 78 shifts to the second position. Because the ports 74 are now in communication with the internal bore 54 via the bore 76, the material, due to gravity, flows out of the tool 16 and into the wellbore 12. Thus, in this embodiment, the materials flow primarily due to the effect of gravity.

After the material has been dispensed, the tool 16 may be retrieved to the surface. At the rig 20 or elsewhere, the barrier 78 may be returned to the first position by using a suitable resetting tool.

It should be appreciated that the present disclosure encompasses a number of variants.

Referring now to FIG. 2, for example, in embodiments, the material dispensing section 50 may be formed as a modular assembly having two or more module 64*a,b*. Additionally, the elongated member 62 may have two or more segments 66*a,b* with each segment having a length corresponding to the modules 64*a,b* of the material dispensing section 50. Thus, the capacity or volume of the material dispensing section 50 may be varied as needed by adding or removing modules to accommodate the amount of material(s) that are to be dispensed into the wellbore.

Also in variants, the elongated member 62 may be formed as a non-rigid member such as a cable or wire. A non-rigid member may also be formed in segments in order to accommodate changes in the length of the material dispensing section 50. Furthermore, while the barrier 78 in embodiments may translate or shift axially to provide access to the ports 74, in other embodiments, the barrier 78 may be configured to operate in a flapper-valve type of action to flip to a non-occluding position. The barrier 78 may also employ rotational movement to align bore or passages to allow the flow of material out of the tool 16. Generally speaking, substantially "rigid" refers to the ability to transmit or support a compressive loading without substantially deforming. Thus, "non-rigid" refers to the ability to support a tensile loading but not a compressive loading.

Additionally, while a wireline deployment is shown, it should be understood that any conveyance device may be utilized to convey the tool 16 into the wellbore 12. For example, a coiled tubing or drill string may be used to convey the tool 16 into the wellbore. In such situations, a firing signal may include a drop bar that is dropped into the wellbore and strikes the detonator to initiate detonation. A firing signal may also include a pressure increase in the wellbore to initiate a pressure-activated detonator. Thus, it should be understood that embodiments of the present disclosure are not limited to wireline conveyed tools or tools initiated by only electrical signals.

Also, in embodiments, a force or pressure may be generated and applied to the material in the internal bore 54 to forcibly eject the material into the wellbore 12. For example, the detonator 44, by itself or with the inclusion of an energetic material, may generate a high pressure gas that propels the piston 32 downward. The piston 32 in turn applies pressure to the material in the internal bore 54, which forces the material out of the tool 16. For instance, the piston 32 may include a central opening that allows the piston 32 to travel or ride along the elongated member 62 and thus function in a syringe type manner. Also, other arrangements such as a motor or a charge of pressurized fluid (e.g., nitrogen) may be activated or applied to eject the material out of the internal bore 54.

It should therefore be appreciated that what has been described includes, in part, an apparatus for activating a wellbore tool. The apparatus may include an upper section having a housing; a piston element that can couple and uncouple from the housing; a detonator in the housing that applies a force sufficient to release the piston element from the housing when activated; an intermediate section having a first end that mates with the upper section and having a bore; an elongated member that has a first end coupled to the piston and a second end, the elongated member being at least partially positioned in the bore of the intermediate section; a lower section having a housing that mates with a second end of the intermediate section, the housing including at least one opening providing communication between a bore of the housing and an exterior of the housing; and a movable barrier in the lower section that has a first position, wherein the barrier substantially blocks communication between the bore of the intermediate section and the at least one opening, and a second position, wherein the barrier does not substantially block communication between the bore of the intermediate section and the at least one opening.

In aspects, the present disclosure also provides a system for actuating a downhole tool. The system may include a conveyance device; and a tool coupled to the conveyance device. The tool may include an upper section; a piston element that couples and uncouples from the upper section; a detonator in the upper section that applies a force sufficient to release the piston element from the upper section when activated; an intermediate section that mates with the upper section and having a bore; an elongated member having a first end coupled to the piston and a second end, the elongated member being at least partially positioned in the bore of the intermediate section; a lower section that mates with a second end of the intermediate section and including at least one opening providing communication between a bore of the intermediate section and an exterior of the tool; and a movable barrier positioned in the lower section, the movable barrier having a first position, wherein the barrier substantially blocks communication between the bore of the intermediate section and the at least one opening, and a second position, wherein the barrier does not substantially block communication between the bore of the intermediate section and the at least one opening. In embodiments, the conveyance device may be a wireline. Also, the system may include a controller configured to transmit a firing signal to the detonator via the wireline.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. Thus, it is intended that the following claims be interpreted to embrace all such modifications and changes.

We claim:

1. An apparatus for activating a wellbore tool, comprising:

an upper section having a housing;

a piston element releasably coupled to the housing;

a detonator in the housing that applies a force sufficient to release the piston element from the housing when activated;

an intermediate section having a first end matable with the upper section and having a bore;

an elongated member having a first end coupled to the piston and a second end, the elongated member being at least partially positioned in the bore of the intermediate section;

a lower section having a housing matable with a second end of the intermediate section, the housing including at least one opening providing communication between a bore of the housing and an exterior of the housing; and a movable barrier in the lower section that has a first position, wherein the barrier substantially blocks communication between the bore of the intermediate section and the at least one opening, and a second position, wherein the movable barrier does not substantially block communication between the bore of the intermediate section and the at least one opening, wherein the piston element, the elongated member, and the movable barrier are connected and move in unison.

2. The apparatus according to claim 1, wherein the elongated member is substantially rigid, and wherein the piston member and the elongated member are configured to hold the movable barrier stationary until the detonator is activated.

3. The apparatus according to claim 1, wherein the elongated member includes at least two segments.

4. The apparatus according to claim 1, wherein the intermediate section is formed of at least two modules.

5. The apparatus according to claim 1, wherein the detonator is configured to detonate in response to an electrical signal.

6. The apparatus according to claim 1, further comprising a frangible member connecting the piston member to the upper section housing.

7. The apparatus according to claim 1, further comprising a detonator block configured to receive the detonator, wherein the piston member sealingly mates with the detonator block.

8. The apparatus according to claim 1, further comprising: a conveyance device coupled to the upper section.

9. The apparatus according to claim 8, wherein the conveyance device is a wireline.

10. The apparatus according to claim 9, further comprising: a controller configured to transmit a firing signal to the detonator via the wireline.

11. A method for activating a wellbore tool, comprising:

conveying the wellbore tool into a wellbore, the tool having:

an upper section having a housing;

a piston element releasably coupled to the housing;

a detonator in the housing that applies a force sufficient to release the piston element from the housing when activated;

an intermediate section having a first end matable with the upper section and having a bore;

an elongated member having a first end coupled to the piston and a second end, the elongated member being at least partially positioned in the bore of the intermediate section;

a lower section having a housing matable with a second end of the intermediate section, the housing including at least one opening providing communication between a bore of the housing and an exterior of the housing;

a movable barrier in the lower section that has a first position, wherein the barrier substantially blocks communication between the bore of the intermediate section and the at least one opening, and a second position, wherein the barrier does not substantially block communication between the bore of the intermediate section and the at least one opening, wherein the piston element, the elongated member, and the movable barrier are connected and move in unison; and activating the detonator.

12. The method according to claim 11, further comprising transmitting an electrical signal to detonate the detonator.

13. The method according to claim 11, further de-coupling the piston member from the upper section housing after detonation of the detonator.

14. The method according to claim 11, wherein a detonator block receives the detonator, further comprising sealingly mating the piston member with the detonator block.

15. An apparatus for activating a wellbore tool, comprising:

a tool having a bore and at least one opening providing communication between the bore of the housing and an exterior of the housing, the bore being configured to store a selected material;

a piston element disposed in the tool bore, the piston element being connected to the tool with at least one frangible element;

a explosive detonator in the tool configured to at least partially disintegrate the at least one frangible element when activated;

a rod disposed in the tool bore, the rod having a first end coupled to the piston element and a second end; and a movable disk connected to the second end of the rod, wherein the piston element and the rod hold the disk stationary against a weight of the selected material, wherein the disk substantially blocks flow of the material through the at least one opening in a first position and allows the material to flow out of the at least one opening in a second position.

16. The apparatus according to claim 15, wherein the rod is substantially rigid.

17. The apparatus according to claim 15, wherein the piston element, the rod, and the disk move in unison from the fist position to the second position.

18. The apparatus according to claim 15, wherein the disk substantially occludes the bore of the tool.

19. The apparatus according to claim 18, wherein the disk is uphole of the at least one opening in the first position and downhole of the at least one opening in the second position.

* * * * *